US006361358B1

(12) United States Patent
Kajinuma

(10) Patent No.: US 6,361,358 B1
(45) Date of Patent: Mar. 26, 2002

(54) FLEXIBLE CIRCUIT BOARD CONNECTING STRUCTURE

(75) Inventor: Shuji Kajinuma, Kanagawa (JP)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/526,385

(22) Filed: Mar. 16, 2000

(51) Int. Cl.[7] ..... H01R 12/24

(52) U.S. Cl. ..... 439/497; 439/329; 439/422; 439/77

(58) Field of Search ..... 439/329, 108, 439/67, 497, 77, 326, 422, 608, 620

(56) References Cited

U.S. PATENT DOCUMENTS 4,639,063 A * 1/1987 Mueller ..... 439/325
4,684,183 A * 8/1987 Kinoshita et al. ..... 439/77
4,695,258 A * 9/1987 Hanson et al. ..... 439/67
4,768,971 A * 9/1988 Simpson ..... 439/329
5,205,750 A * 4/1993 Darrow et al. ..... 439/77
5,967,799 A * 10/1999 Arai ..... 439/67
6,010,659 A * 1/2000 Etters et al. ..... 439/496

OTHER PUBLICATIONS

Japanese Abstract JP10284201, Relay Connector With Shield Mechanism, Application No. 09081129, Filed 19970331, Published 19981023.

* cited by examiner

*Primary Examiner*—P. Austin Bradley
*Assistant Examiner*—James R. Harvey

(57) ABSTRACT

A conductive supporting plate (150) is fastened to the engaging end part (130) of a flexible circuit board (190) so that the conductive supporting plate (150) is connected to the ground surface of the flexible circuit board (190). The conductive supporting plate is installed on the engaging end part 130 of the flexible circuit board (190). The flexible circuit board (190) is accommodated together with the conductive supporting plate (150) in a board-mounted connector (20) on a mating side, and is fastened to the board-mounted connector (20) by screw means (105). The conductive supporting plate (150) is pressed against grounding means (70) installed on the board-mounted connector (20) by the screw means (105).

6 Claims, 5 Drawing Sheets

FLEXIBLE CIRCUIT BOARD CONNECTING STRUCTURE

FIELD OF THE INVENTION

The present invention concerns a flexible circuit board connecting structure which is used to connect a flexible circuit board (such as a flexible printed circuit, FPC) that has a ground surface with another circuit board.

BACKGROUND OF THE INVENTION

An example of a conventional technique of this type is disclosed in Japanese Patent Application Kokai No. 10-284201. That patent application discloses a board-mounted connector mounted on a circuit board, and a relay connector which terminates a flexible circuit board that has a ground surface, and which can be engaged with the board-mounted connector. The relay connector has a plurality of signal contacts which are used to make connections with the signal circuit traces of the flexible circuit board, an insulating housing which accommodates these signal contacts, and a shielding assembly which is disposed so that it surrounds the insulating housing. In other words, in the relay connector, the signal circuit of the flexible circuit board is connected to the signal contacts, and the ground surface is connected and electrically grounded to the shielding assembly disposed on the outer circumference.

The board-mounted connector disclosed by Japanese Patent Application Kokai No. 10-284201 has a plurality of signal contacts, a housing which accommodates these signal contacts, and a shielding member which is disposed around the outer circumference of the connector. When the relay connector is engaged with the board-mounted connector, the contacts are electrically connected to each other, and the shielding assembly and shielding member are both connected. In this way, mutual signal and ground connections are realized between the flexible circuit board and the other circuit board.

SUMMARY OF THE INVENTION

In the technique disclosed in the abovementioned patent application, manufacture and assembly are difficult, so that the cost of the device is increased. Furthermore, in cases where a large external force is applied to the flexible circuit board, there is a danger that the mutual engagement of the contacts will be released. This is disadvantageous for special applications. Accordingly, the first object of the present invention is to realize a highly reliable and comparatively simple construction for making connections between a flexible circuit board with a ground surface and another circuit board. A second object of the present invention is to provide a flexible circuit board connecting structure which makes it possible to maintain highly reliable signal and ground connections even in cases where a large external force is applied to the flexible circuit board.

The present invention provides a flexible circuit board connecting structure in which a flexible circuit board that has a ground surface and a second circuit board are connected via a board-mounted connector which is mounted on the second circuit board. A metal conductive supporting plate is connected to the ground surface and supports an engaging end portion of the flexible circuit board accommodated in the board-mounted connector. The metal conductive supporting plate is crimped on the flexible circuit board, and is connected to a grounding means installed in the board-mounted connector. The conductive supporting plate may be mechanically engaged with the grounding means.

The present invention also provides a flexible circuit board connecting structure in which a flexible circuit board that has a ground surface and a second circuit board are connected via a board-mounted connector which is mounted on the second circuit board, and the flexible circuit board is fastened in the connected position with the board-mounted connector by screw means. The grounding connection between the flexible circuit board and the board-mounted connector is realized by means of a driving force directed toward the second circuit board by the screw means. The board-mounted connector may be equipped with a temporary holding means that temporarily fastens the flexible circuit board prior to the fastening effected by the screw means.

Additionally, the board-mounted connector is equipped with conductive members that are connected to the second circuit board, and the ground surface of the flexible circuit board forms a ground path that extends to the second circuit board via the conductive members. The board-mounted connector also has a grounding shell which is installed so that this grounding shell surrounds the outer surface of the board-mounted connector, and the grounding shell is constructed so that it makes electrical contact with the members.

BRIEF DESCRIPTION OF THE DRAWINGS

The present invention will now be described by way of example with reference to the accompanying drawings, in which:

FIG. 2(*a*) is prior to assembly, and FIG. 2(*b*) shows a temporary holding state.

FIG. 3(*a*) is a plan view, and FIG. 3(*b*) is a side view.

DETAILED DESCRIPTION OF THE INVENTION

Figure 1:
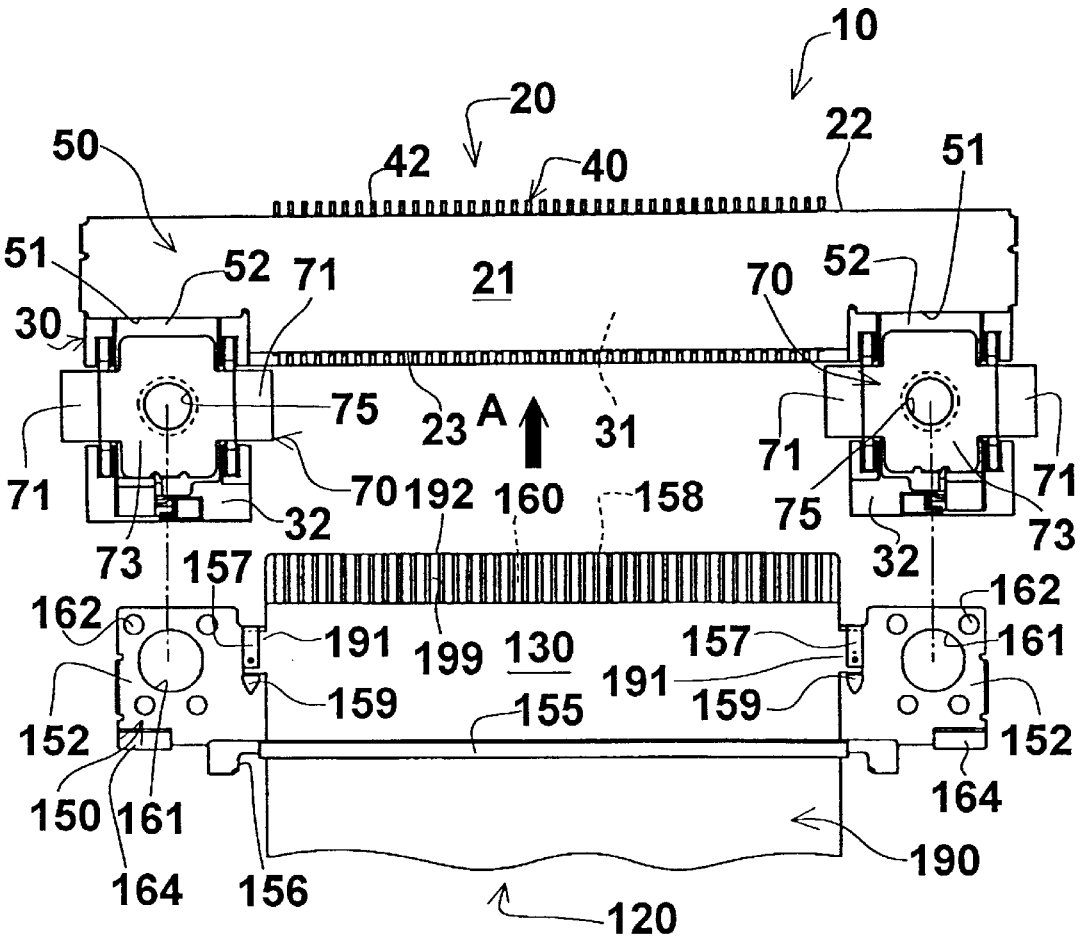
FIG. 1 is a plan view which shows the board-mounted connector and flexible circuit board assembly used in the flexible circuit board connecting structure of the present invention.
Figure 2A:
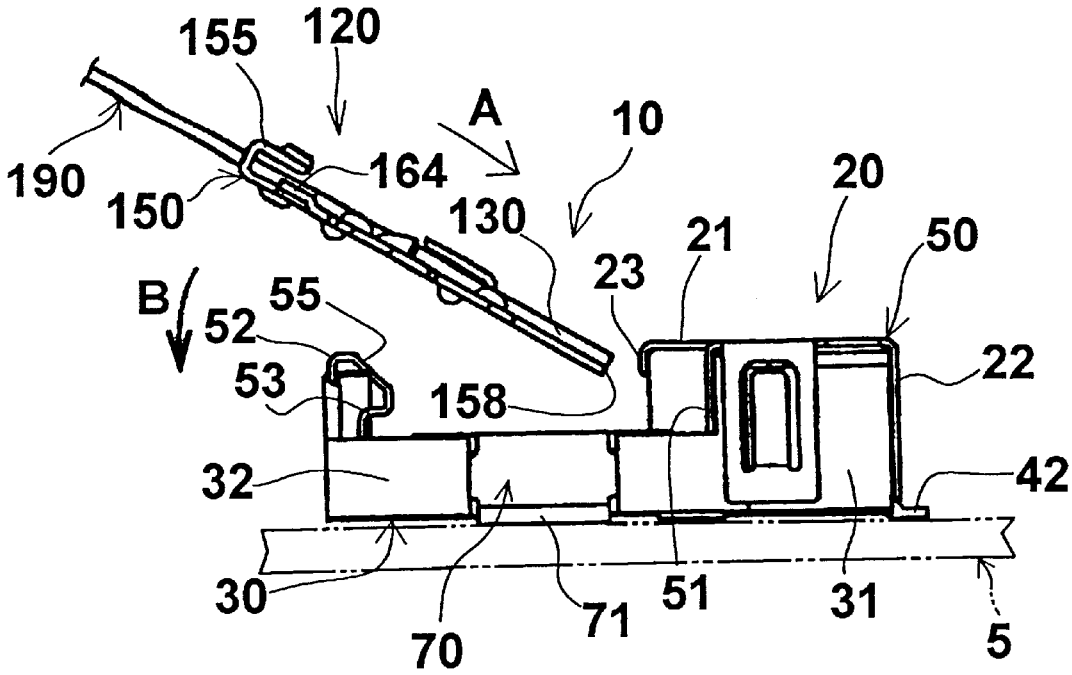
FIG. 2 shows side views of the board-mounted connector and flexible circuit board assembly shown in FIG. 1.
Figure 2B:
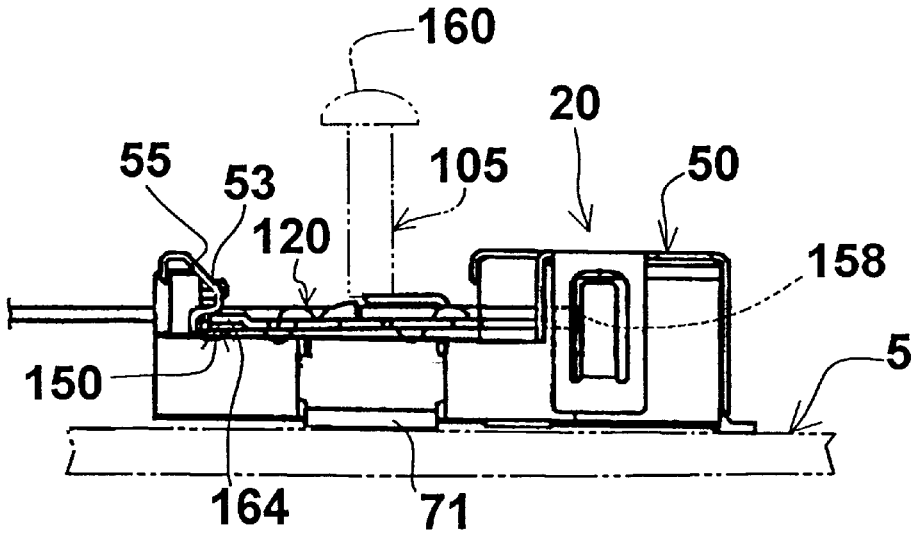

As shown in FIGS. 1 and 2, the flexible circuit board connecting structure 10 has a board-mounted connector 20 which can be mounted on a circuit board 5, and a flexible circuit board terminating structure 120. Both of these parts are constructed so that they can be engaged with each other. Signal and ground connections between a flexible circuit board 190 and the circuit board 5 are realized by this engagement. These structures will be described in detail below, in the order mentioned.

The board-mounted connector 20 has a housing 30, a conductive shell 50 which is disposed along the outside surface of the housing 30, and fastening conductive members 70 which are used to increase the strength of the fastening of the housing 30 to the circuit board 5. The housing 30 has a base part 31 which extends in the direction of length, and arm parts 32 which extend to one side from both ends of the base part 31 so that the arm parts 32 are perpendicular to the base part 31. Thus, the housing 30 is substantially C-shaped. A plurality of signal contacts 40 are accommodated inside the base part 31. The signal contacts 40 may have contact parts similar to the fork type contact parts used in ordinary socket connectors. The contacts 40 and conductive members 70 are respectively equipped with surface-mounting type tines 42 and connecting plates 71. The respective conductive members 70 extend across the arm parts 32, and are each equipped with a pair of connecting plates 71 that are positioned on both sides of the arm parts 32.

The conductive shell 50 extends along the entire length of the housing 30, and is disposed so that it is wrapped around the top surface 21 of the board-mounted connector 20, the rear surface 22 of the connector, and a portion of the front surface 23 which is located on an engagement side of the connector 20. The conductive shell 50 also has extension parts 52 that extend in the direction perpendicular to the direction of length of the housing 30 from positions near both ends of the shell 50 via step parts 51. These extension parts 52 are positioned with respect to the housing 30 by a construction that will be described later, and are prevented from slipping out by the conductive members 70 installed from above.

Figure 4:
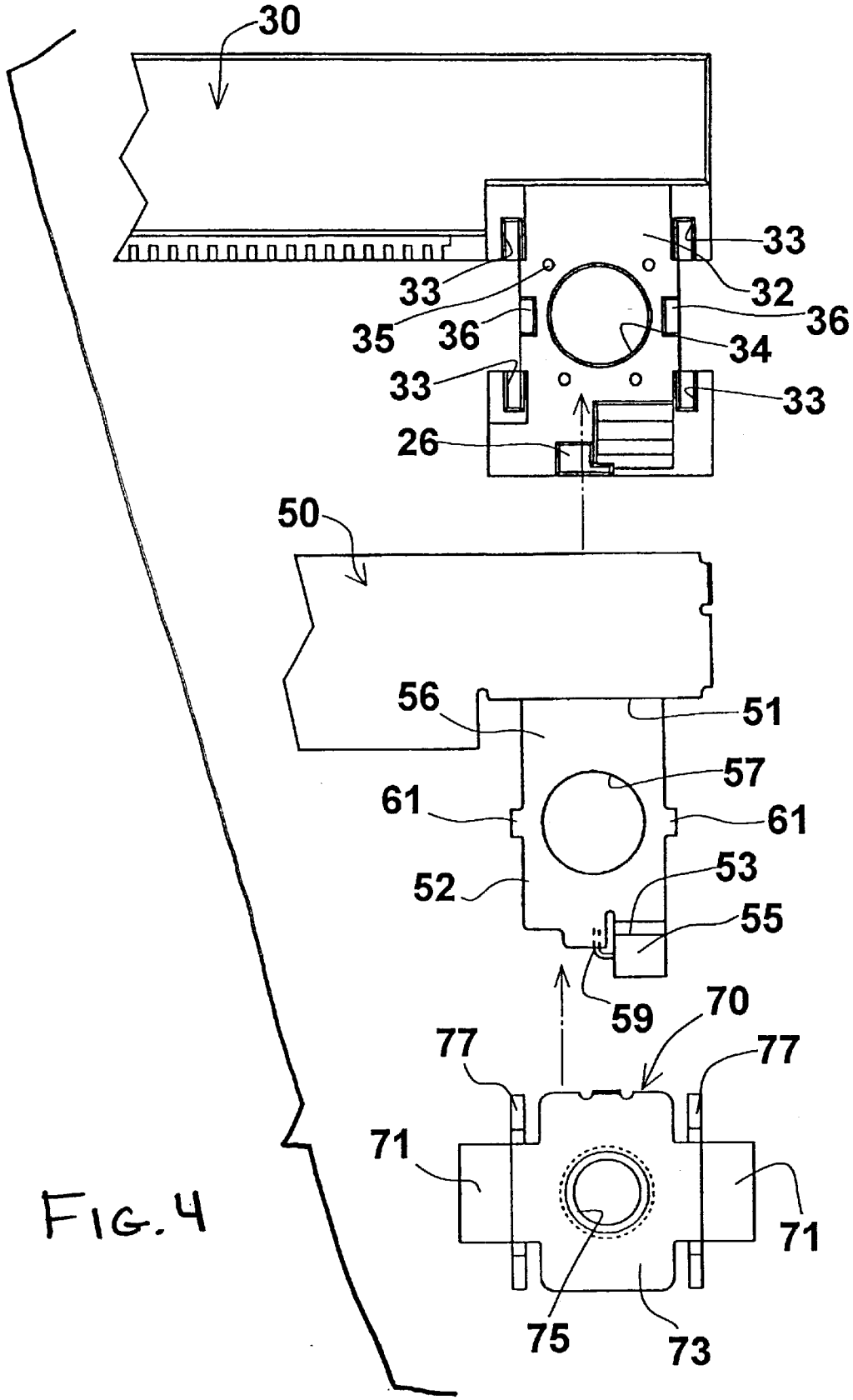
FIG. 4 is an exploded partial plan view which illustrates the construction of one end of the housing and conductive shell, and one of the conductive members.
Figure 5:
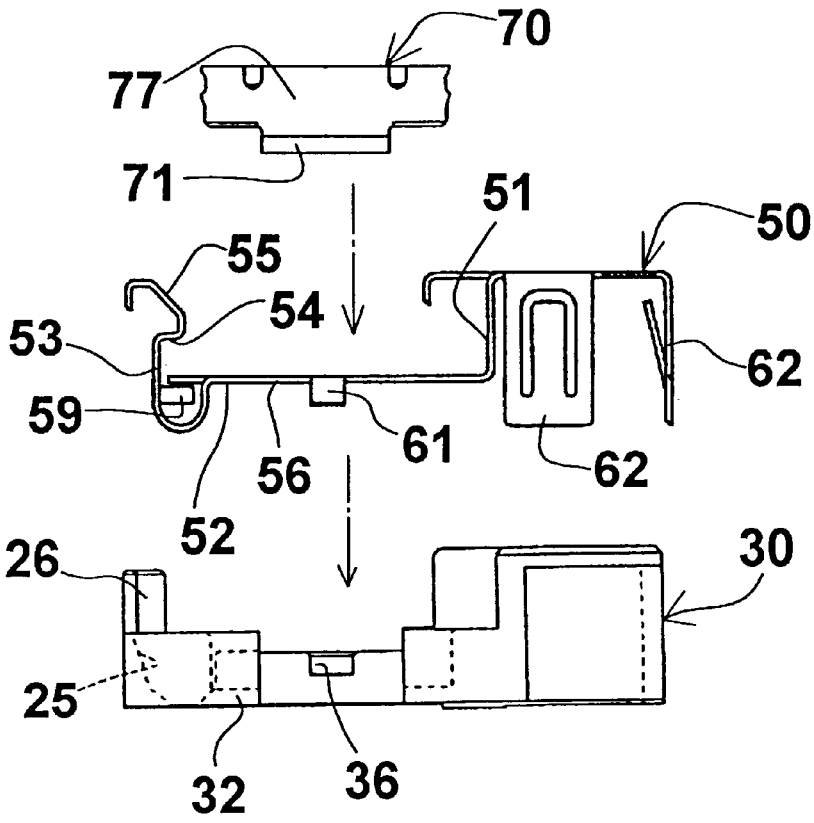
FIG. 5 is an exploded side view which illustrates the construction of one end of the housing and conductive shell, and one of the conductive members.

As shown in FIG. 5, the conductive shell 50 is first installed on the housing 30, after which the conductive members 70 are installed from the top side. As shown in FIG. 4, holes 34 are formed in the centers of the arm parts 32, and a plurality of projections 35 are formed around each hole 34 on the top surface side of the arm part 32. Recesses 36 are formed in both side edges of the top surface of each arm part 32, in positions located roughly at the center of each arm part 32.

At the time of assembly, the conductive shell 50 is first attached to the housing 30. Latches 62 (see FIG. 5) formed along the rear edge and side edges of the conductive shell 50 engage with the housing 30, so that the conductive shell 50 is fastened to the housing 30. On the arm parts 32, the horizontal plate parts 56 of the extension parts 52 are carried on the plurality of projections 35, and the protruding parts 61 are positioned so that they overlap with the recesses 36. An opening 57 is formed substantially in the center of each horizontal plate part 56, and this opening 57 is roughly aligned with the hole 34 of the corresponding arm part 32. The openings 57 may have a slightly larger diameter than the holes 34.

Clip structures 53 are formed on the tip ends of both extension parts 52 of the conductive shell 50. Each of these clip structures 53 has an elastically flexible construction which is bent into a U-shape on the bottom side near the front end of the corresponding extension part 52, and which extends toward the top. A locking shoulder 54 and an operating part 55 which is used to release the lock are located near the tip end. A recess 25 which is used to accommodate the U-shaped portion of the clip structure 53 and maintain a space that allows elastic deformation is formed in each arm part 32. Furthermore, one side surface of each recess 25 engages with a supporting part 59 that extends in the horizontal direction from the corresponding clip structure 53, and maintains the attitude of the clip structure 53. A protective column 26 is installed near the clip structure 53 of each arm part 32 in order to prevent deformation of the clip structure 53.

Figure 6:
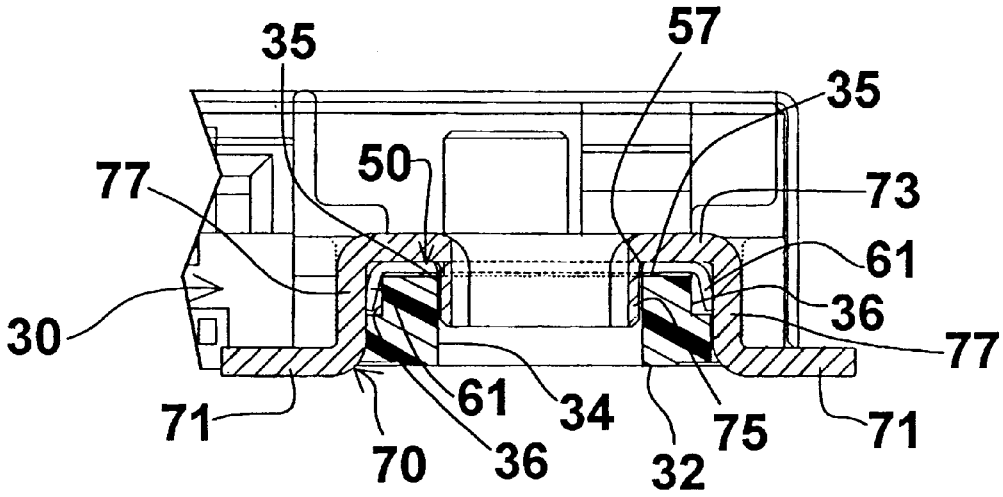
FIG. 6 is a sectional view which shows the housing and conductive shell assembled.

After the conductive shell 50 has been attached to the housing 30, the conductive members 70 are attached. The conductive members 70 are fastened in place as a result of press-fitting walls 77 that extend from both sides of each conductive member 70 being accommodated in press-fitting grooves 33 formed in the arm parts 32 of the housing 30. The conductive members 70 are fastened so that the connecting plates 71 are positioned in specified positions. Screw engagement receiving parts 75 which are constructed so that they protrude toward the bottom are formed in the top walls 73 of the conductive members 70. As shown in FIG. 6, the screw engagement receiving parts 75 are passed through the openings 57 of the conductive shell 50, and extend into the interiors of the holes 34 in the housing 30.

The screw engagement receiving parts 75 have no particular engagement relationship with the openings 57 or holes 34. However, when the conductive members 70 are mounted, the protruding parts 61 of the conductive shell 50 elastically contact the inside surfaces 76 of the press-fitting walls 77 as shown in FIG. 6. As a result, electrical continuity is established between the conductive shell 50 and the conductive members 70. The recesses 36 in the arm parts 32 are used to maintain an elastic flexing space for the protruding parts 61.

Figure 3A:
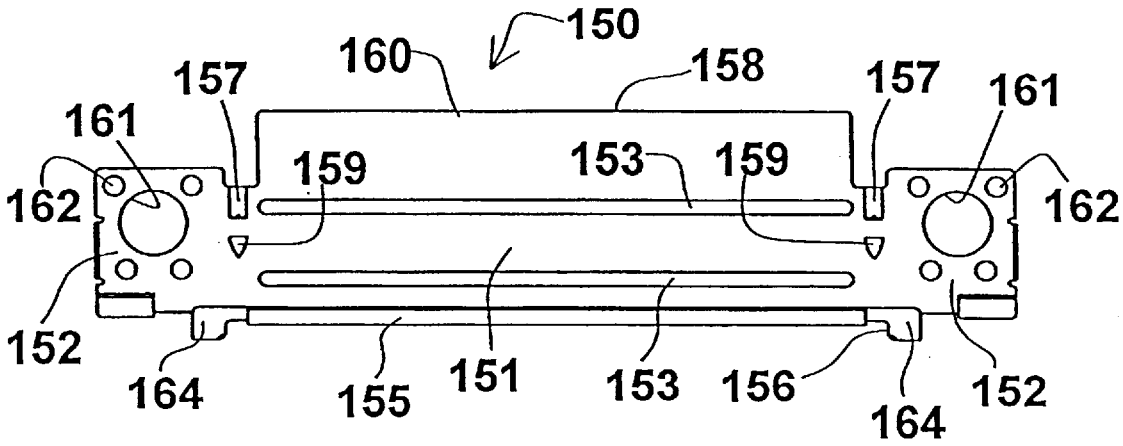
FIG. 3 shows the conductive supporting plate used in the flexible circuit board assembly shown in FIGS. 1 and 2.
Figure 3B:
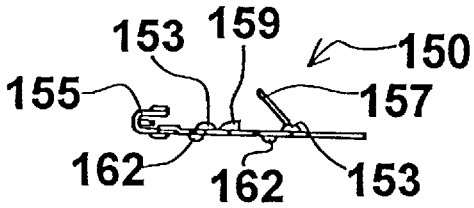

Returning to FIGS. 1 through 3, the flexible circuit board assembly 120 has a flexible circuit board end part 130 and a conductive supporting plate 150 which is positioned near the tip end of the flexible circuit board end part 130. As will be seen by reference to FIG. 3 as well, the conductive supporting plate 150 is manufactured by the stamping and bending of a conductive metal plate, and has a base part 151 which extends in the direction of width, and end parts 152 which are positioned at both ends. A relatively large hole 161 and a plurality of projections 162 are formed in each of the end parts 152. Beads 153 which extend in the direction of width are formed on the base part 151 for reinforcement. Furthermore, a U-shaped wall 155 is formed on the rear edge 154 of the base part 151. A receiving slot which receives the flexible circuit board 190 by allowing the flexible circuit board 190 to pass through is formed in the U-shaped wall 155. Furthermore, at the tip end of the U-shaped wall 155, the metal plate is folded along the direction of length so that a two-layer structure is formed.

The state of the conductive supporting plate 150 when the flexible circuit board 190 is accommodated can be seen from FIGS. 1 and 2. There is a slight narrowing at the boundary between the base part 151 and end parts 152 of the conductive supporting plate 150, and tongue parts 157 used for crimping extend from the front edge 156 at these boundaries. The flexible circuit board 190 is received via the receiving slot in the U-shaped wall 155, and is positioned so that wing parts 191 positioned on both side edges of flexible circuit board 190 substantially contact the tongue parts 157. The tip end 192 of the flexible circuit board 190 is substantially aligned with the leading edge 158 of the base part 151. The width of the flexible circuit board 190 is substantially aligned with the width of the protruding part 160 positioned on the front side of the conductive supporting plate 150. As a result, the plurality of signal pads 199 on the flexible circuit board 190 are accurately disposed in specified positions along the leading edge 158 facing the opposite side from the conductive supporting plate 150.

The wing parts 191 of the properly positioned flexible circuit board 190 are fastened in place by crimping of the tongue parts 157. It should be noted that the conductive supporting plate 150 has stopping projections 159 that can stop the rearward movement of the wing parts 191 both during and after crimping. Furthermore, the movement of the flexible circuit board 190 in the lateral direction can also be regulated by setting the dimensions of the tongue parts 157 at appropriate values.

The crimping of the tongue parts 157 is also used for the purpose of making ground connections. The ground circuit of the flexible circuit board 190 has contact pads used for grounding on the bottom surfaces or top surfaces of the wing part 191. When the wing parts 191 are crimped by the tongue parts 157, the contact pads and the conductive supporting plate 150 are ground-connected by the pressing force caused by the crimping. Accordingly, the conductive supporting plate 150 is placed at the ground potential.

In the assembly of the board-mounted connector 20 with the flexible circuit board assembly 120, the flexible circuit board assembly 120 is first aligned with the board-mounted connector 20 and accommodated in the board-mounted connector 20 from the inclined direction indicated by arrow A, as shown in FIG. 1 and FIG. 2(*a*). After the leading edge 158 of the base part 151 of the conductive supporting plate 150 reaches a specified position inside the board-mounted connector 20, the flexible circuit board assembly 120 is pivoted in the pivoting direction indicated by arrow B. As a result, the conductive supporting plate 150 is temporarily engaged with the board-mounted connector 20 so that it is caused to face in the horizontal direction as shown in FIG. 2(*b*).

This temporary engagement or temporary holding is realized by the elastic engagement of the end parts 164 of the conductive supporting plate 150 and the clip structures 53, while the tip end of the flexible circuit board 190 and the area in the vicinity of the leading edge 158 of the conductive supporting plate 150 make elastic contact with the contacts of the board-mounted connector 20. In this state, it should be noted that signal connections between the flexible circuit board 190 and the contacts 40 are established, and that the end parts 152 of the conductive supporting plate 150 are positioned so that they overlap with the top walls 73 of the conductive members 70.

In the final process of assembly, fastening is accomplished by the tightening of screws. The screws 105 are positioned so that they pass through the holes 161 formed in the end parts 152 from the side of the top surface of the conductive supporting plate 150, and are engaged with the screw engagement receiving parts 75 of the conductive members 70. The screw heads 160 tighten the conductive supporting plate 150 onto the conductive members 70. As a result, a grounding connection is established between the conductive supporting plate 150 and the conductive members 70. Furthermore, in the present working configuration, since the system is constructed so that there is electrical continuity between the conductive members 70 and the conductive shell 50 as described above, a ground circuit path is also effected between the conductive supporting plate 150 and the conductive members 70 via the clip structures 53.

As a result of such a construction, stable signal and ground connections are established between the flexible circuit board 190 and the circuit board 5. Handling of the flexible circuit board 190 is made easy and ground connections are made easy. In addition, the construction is simplified. Furthermore, strong fastening of the flexible circuit board assembly 120 can be accomplished using screw means, and the ground connection means is realized using a relatively simple construction.

The flexible circuit board connecting structure of the present invention and many of its attendant advantages will be understood from the foregoing description. It is apparent that changes may be made in the form, construction, and arrangement of parts thereof without departing from the spirit of the invention, or sacrificing all of its material advantages. Thus, while the present embodiment of the invention has been disclosed, it is to be understood that the invention is not strictly limited to such embodiment but may be otherwise variously embodied and practiced within the scope of the appended claims.

I claim:

1. A flexible circuit board connecting structure for connecting a flexible circuit board having a ground surface to a second circuit board, comprising:

a board mounted connector mounted on the second circuit board; and a conductive supporting plate connected to the ground surface, supporting an engaging end portion of the flexible circuit board which is received in the board-mounted connector, and the conductive supporting plate is ground-connected to a grounding means installed in the board-mounted connector, wherein the flexible circuit board has wing sections having ground surfaces and the conductive supporting plate has tongue parts which are crimped onto the wing sections.

2. The flexible circuit board connecting structure claimed in claim 1, wherein the conductive supporting plate is mechanically engaged with the aforementioned grounding means.

3. The flexible circuit board connecting structure claimed in claim 1, wherein the grounding means is a conductive shell disposed on the board mounted connector.

4. A flexible circuit board connecting structure for connecting a flexible circuit board having a ground surface to a second circuit board, comprising:

a board mounted connector mounted to the second circuit board; wherein the flexible circuit board is fastened in a connected position within the board-mounted connector by a holding means having at least one screw, and a grounding connection is realized between the flexible circuit board and the board-mounted connector by way of a driving force directed toward the second circuit board by the screw; and, the board mounted connector has a grounding shell surrounding an outer surface of the board mounted connector, the sounding shell electrically contacting the second circuit board.

5. The flexible circuit board connecting structure claimed in claim 4, wherein the board-mounted connector is equipped with conductive members that are connected to the second circuit board, and the ground surface of the flexible circuit board forms a ground path that extends to the second circuit board via the conductive members.

6. The flexible circuit board connecting structure claimed in claim 4, wherein the holding means is an elastic metal clip.

* * * * *